US011520259B2

(12) United States Patent
Iwasawa

(10) Patent No.: US 11,520,259 B2
(45) Date of Patent: Dec. 6, 2022

(54) SHEET DISCHARGE DEVICE AND IMAGE FORMING APPARATUS

(71) Applicant: CANON KABUSHIKI KAISHA, Tokyo (JP)

(72) Inventor: Ryo Iwasawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/332,157

(22) Filed: May 27, 2021

(65) Prior Publication Data

US 2021/0382419 A1 Dec. 9, 2021

(30) Foreign Application Priority Data

Jun. 5, 2020 (JP) ..... JP2020-098734

(51) Int. Cl.
*G03G 15/20* (2006.01)
*B65H 29/14* (2006.01)

(52) U.S. Cl.
CPC ..... *G03G 15/2028* (2013.01); *B65H 29/14* (2013.01)

(58) Field of Classification Search
CPC ..... G03G 15/2028
See application file for complete search history.

(56) References Cited

FOREIGN PATENT DOCUMENTS

| | | | |
|---|---|---|---|
| JP | H06183628 A | | 7/1994 |
| JP | H10-157905 A | | 6/1998 |
| JP | 2005096965 A | | 4/2005 |
| JP | 2010070281 A | * | 4/2010 |
| JP | 2013032213 A | | 2/2013 |
| JP | 2018151604 A | | 9/2018 |

OTHER PUBLICATIONS

JP_2005096965_A_I Machine Translation, Japan, 2005, Kawamoto.*
JP_06183628_A_I Machine Translation, Japan, 1994, Isoda.*

* cited by examiner

*Primary Examiner* — Victor Verbitsky
(74) *Attorney, Agent, or Firm* — Canon U.S.A., Inc. I.P. Division

(57) ABSTRACT

A sheet discharge device includes a discharge unit including a drive roller, to be rotated by a drive source driving force, a driven roller to be driven by the drive roller, and a static elimination unit located downstream from the discharge unit in a sheet discharge direction. The discharge unit discharges a sheet out of a discharge nip portion between the drive roller and the driven roller. The static elimination unit eliminates electric charge from the sheet to be discharged. The static elimination unit includes a static elimination cloth having electroconductive fiber and facing the sheet to be discharged and includes a support member supporting the static elimination cloth. The static elimination cloth is located so that a static elimination plane of the static elimination cloth, constituting a virtual plane facing the sheet, is substantially parallel to a virtual tangent line extending from the discharge nip portion.

8 Claims, 12 Drawing Sheets

SHEET DISCHARGE DEVICE AND IMAGE FORMING APPARATUS

BACKGROUND

Field

The present disclosure relates to a sheet discharge device which discharges sheets and an image forming apparatus provided with the sheet discharge device.

Description of the Related Art

Conventional image forming apparatuses applicable to copy machines, printers, multifunction peripherals having the copying functionality and printer functionality, facsimiles, and the like are provided with discharge devices. The discharge device includes a discharge unit for discharging sheets with images thereon outside the apparatus. Some sheets discharged from the discharge outlet remain charged because the electric charge built up in the image forming process or through rubbing friction in conveyance paths are not completely eliminated. Thus, if the sheets are discharged as they are, they may stick to the discharge tray, a printer exterior component, or a stacked sheet due to the remaining static electricity. According to Japanese Patent Application Laid-Open No. 10-157905, a static elimination brush is provided near a discharge outlet as a static elimination unit for eliminating electric charge from sheets. The static elimination brush is provided at the discharge outlet to be in direct contact with sheets discharged from the discharge outlet.

SUMMARY

The present disclosure is directed to the provision of a sheet discharge device and an image forming apparatus reducing deterioration of static elimination performance.

According to an aspect of the present disclosure, a sheet discharge device to discharge a sheet includes a discharge unit including a drive roller to be rotated by a driving force received from a drive source and a driven roller to be driven by the drive roller, wherein the discharge unit is configured to discharge the sheet out of a discharge nip portion between the drive roller and the driven roller, and a static elimination unit located downstream from the discharge unit in a sheet discharge direction and configured to eliminate electric charge from the sheet to be discharged by the discharge unit, wherein the static elimination unit includes a static elimination cloth having electroconductive fiber and facing the sheet to be discharged by the discharge unit and includes a support member supporting the static elimination cloth, and wherein the static elimination cloth is located so that a static elimination plane of the static elimination cloth, constituting a virtual plane facing the sheet, is substantially parallel to a virtual tangent line extending from the discharge nip portion.

Further features of the present disclosure will become apparent from the following description of exemplary embodiments with reference to the attached drawings.

DESCRIPTION OF THE EMBODIMENTS

Some exemplary embodiments of the present disclosure will be described in detail below with reference to the attached drawings.

A first exemplary embodiment will be described with reference to FIG. 1. In the present exemplary embodiment, an example will be described of a multifunction peripheral 10 provided with an image reading apparatus 40 including a known flat-bed type scanner over an image forming apparatus 30. Coordinate axes in the present exemplary embodiment are defined as an X axis in the horizontal direction, a Z axis in the perpendicular direction as illustrated in FIG. 1, and a Y axis in the sheet width direction of sheets S to be conveyed.

First, a configuration of the multifunction peripheral 10 and an image forming process according to the present exemplary embodiment will be described with reference to FIG. 1.

Figure 1:
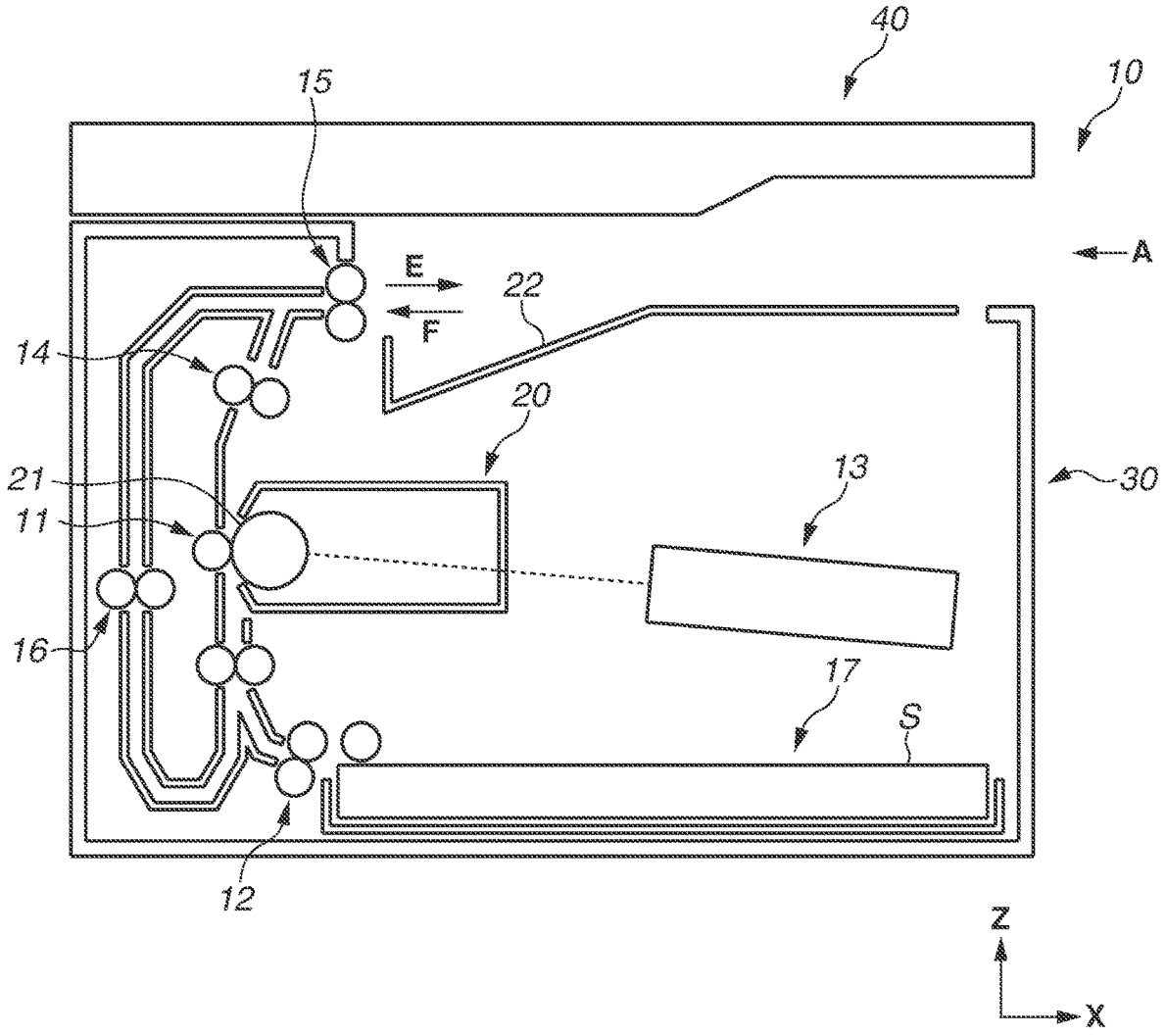
FIG. 1 is a schematic cross-sectional view of a multifunction peripheral according to a first exemplary embodiment.

FIG. 1 is a schematic cross-sectional view of the multifunction peripheral 10. The multifunction peripheral 10 includes the image forming apparatus 30 and the image reading apparatus 40. The image forming apparatus 30 includes an image forming unit 11, a sheet conveyance unit 12, a laser scanner unit 13, a fixing unit 14, a discharge unit 15, a duplex printing unit 16, and a storage unit 17. According to the present exemplary embodiment, the discharge unit 15 as a part of the image forming apparatus 30 is a sheet discharge device to discharge sheets. The sheet discharge device may be any sheet discharge device including a static elimination unit described below. In some embodiments, the sheet discharge device is a separate optional device connected to the image forming apparatus 30, and is applicable to a post processing apparatus and a stabling process apparatus, both of which are provided with multiple stacking trays to stack discharged sheets.

Each of the sheets S stored in the storage unit 17 is conveyed to the image forming unit 11 by the sheet conveyance unit 12 in response to a print command. The image forming unit 11 includes a process cartridge 20, which is removably installed in the main body of the image forming apparatus 30, and the process cartridge 20 includes a photosensitive drum 21 as an image bearing member. The laser scanner unit 13 emits laser beams based on the image information with the print command, forming an electrostatic latent image on the surface of the photosensitive drum 21. The electrostatic latent image is developed by a development device not illustrated, so that a toner image is formed on the surface of the photosensitive drum 21. The toner image is transferred to the conveyed sheet S, and then the sheet S is conveyed to the fixing unit 14.

The fixing unit 14 fixes the toner image to the sheet S, completing printing on a first surface. In a simplex printing, the sheet S is conveyed in a conveyance direction E by a discharge roller set in the discharge unit 15 and is discharged onto a discharge tray 22. In a duplex printing, the sheet S is switchbacked in a conveyance direction F, and is conveyed to a duplex printing unit 16. Through the duplex printing unit 16, the sheet S passes in a duplex printing conveyance path, and is sent again to the image forming unit 11, in which printing on the second surface is performed in the process as with the first surface. After the printing on the second surface is completed, the sheet S is conveyed in the conveyance direction E by the discharge roller set in the discharge unit 15, and is discharged onto the discharge tray 22.

Figure 2A:
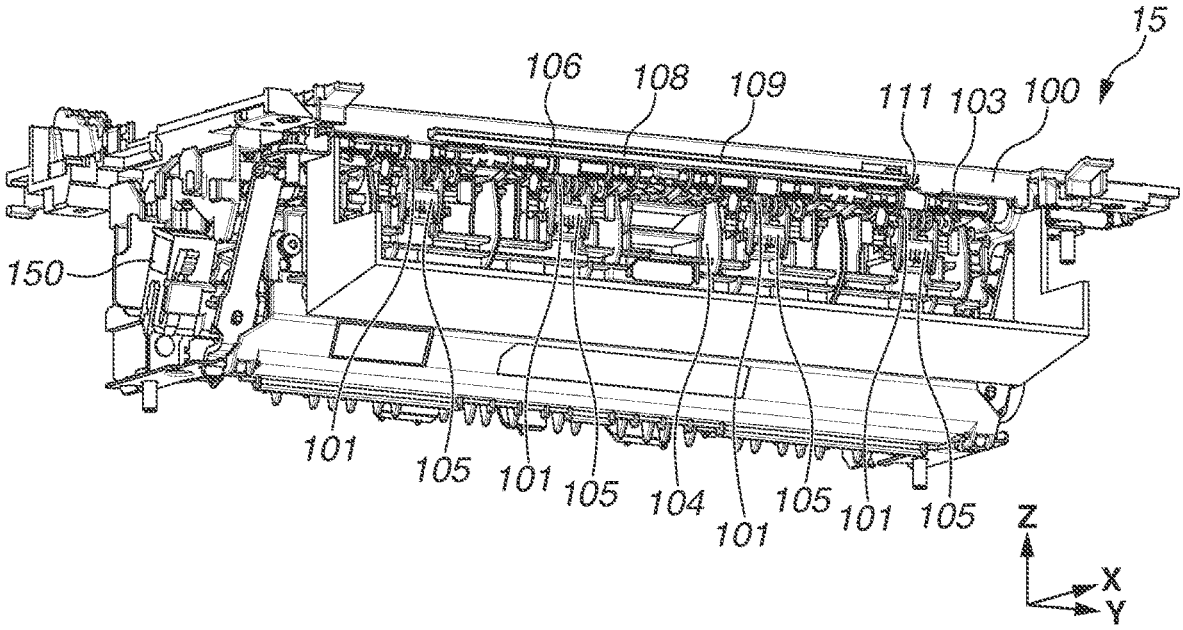
FIGS. 2A and 2B are schematic perspective views of a discharge unit according to the first exemplary embodiment.
Figure 2B:
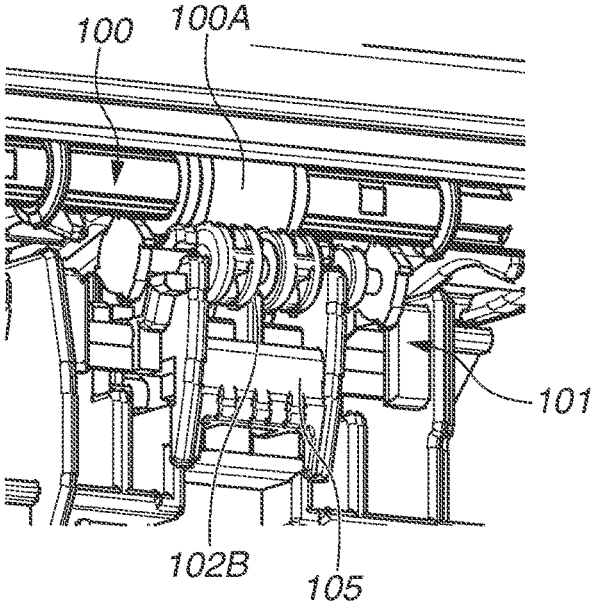
Figure 3:
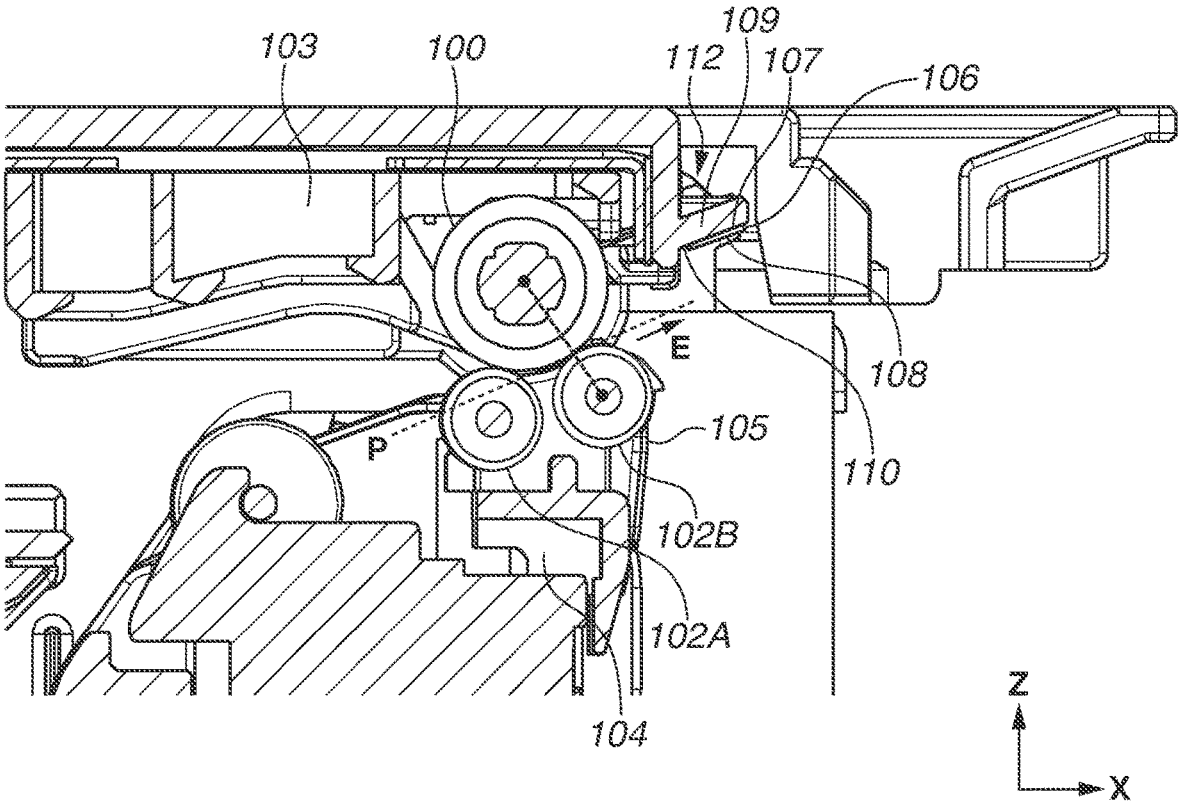
FIG. 3 is a schematic cross-sectional view near a discharge roller set in the discharge unit according to the first exemplary embodiment.

Next, a configuration of the discharge unit 15 will be described in detail with reference to FIGS. 2A and 2B to 4. FIGS. 2A and 2B are a schematic perspective view and a partial enlarged view of the discharge unit 15, respectively. FIG. 3 is a schematic cross-sectional view near the discharge roller set in the discharge unit 15. As illustrated in FIGS. 2A, 2B, and 3, the discharge unit 15 includes a discharge roller 100 as a discharge unit which is a drive roller rotated by a drive source not illustrated. The discharge roller 100 includes a plurality of drive rotation portions 100A (four portions according to the present exemplary embodiment). The drive rotation portions 100A rotate in contact with a sheet in the roller axial direction. The discharge unit 15 includes a driven roller 101. The driven roller 101 is a driven rotation member driven and rotated by the discharge roller 100. As illustrated in FIG. 3, the driven roller 101 includes discharge rollers 102A and 102B as driven rotation portions at positions of each corresponding drive rotation portion 100A.

The discharge unit 15 includes the discharge roller set consisting of the discharge roller 100 and the driven roller 101, with which discharge nip portions are formed. The discharge roller set is a discharge unit which discharges sheets out of the discharge nip portions. The discharge unit 15 includes a discharge upper guide 103 rotatably supporting the discharge roller 100. The discharge unit 15 further includes a discharge roller holder 105 rotatably supporting the discharge rollers 102A and 102B. The discharge roller holder 105 is supported by a discharge lower guide 104.

The discharge roller 100 is rotated by a driving force received from the drive source not illustrated in the rotation direction set on a drive train switched by a solenoid 150. The discharge rollers 102A and 102B form nip portions, respectively, in pressure contact with the discharge roller 100 and are driven and rotated by the rotation of the discharge roller 100 in the rotation direction of the discharge roller 100. As a countermeasure against wrinkles in sheets according to the present exemplary embodiment, the driven roller 101 includes the discharge roller 102B, a first driven rotation member forming a discharge nip portion for discharging sheets, and the discharge roller 102A, a second driven rotation member disposed upstream from the discharge roller 102B. The driven roller 101 is not limited to the above-described configuration and may constitute, for example, a driven rotation member which forms a discharge nip portion with the discharge roller 100.

The discharge unit 15 includes a static elimination unit 112 for eliminating electric charge from sheets. The static elimination unit 112 includes a static elimination member 106 in a sheet-like form, a static elimination support member 109, and a grounding member 111 for grounding the static elimination member 106. The static elimination member 106 is disposed downstream from the discharge roller set in the conveyance direction E of the sheet S. The static elimination member 106 is a static elimination cloth 106, a sheet-like non-woven fabric with an adhesion surface 107 and a fiber surface 108 of the other side. The fiber surface 108 is a virtual plane formed of uneven fibers, not a perfect plane. As illustrated in FIG. 3, the fiber surface 108 is disposed to be substantially parallel to the direction E, in which sheets are discharged. The sheet discharge direction E is the direction of a virtual tangent line P perpendicular to the virtual line connecting the rotation axis of the discharge roller 100 and the rotation axis of the discharge roller 102B and extending from the discharge nip portion (refer to FIG. 3).

The static elimination cloth 106 is a non-woven fabric in a sheet-like shape, including electroconductive fiber. In some embodiments, the static elimination cloth 106 is different in material from a non-woven fabric, such as a woven fabric or a knitted fabric with electroconductive fiber woven therein. The electroconductive fiber included in the static elimination cloth 106 has many cross sections on which electric charge tends to concentrate as with a needle electrode and thus causes corona discharge with a low voltage. In short, the static elimination cloth 106 has the static elimination function of eliminating electric charge from an object in corona discharge out of contact with the static elimination cloth 106.

The adhesion surface 107 adheres to a support surface 110 of the static elimination support member 109 with double-sided adhesive tape, by which the static elimination support member 109 fixes and supports the static elimination cloth 106 with the fiber surface 108 exposed to a conveyance area of the sheet S. This enables electric charge on the conveyed sheet S to be eliminated in aerial discharge. The static elimination support member 109 is an exterior component of the image forming apparatus 30 and has the support surface 110 as a part of the exterior component. Further, the grounding member 111 is provided near one edge portion of the static elimination cloth 106 in the width direction of the sheet S. The grounding member 111 lies between the static elimination cloth 106 and the static elimination support member 109 and is in constant contact with the static elimination cloth 106. The other edge of the grounding member 111 is connected to a ground path not illustrated. This provides an efficient removal of electric charge on the sheet S in discharge of the sheet S.

Figure 4:
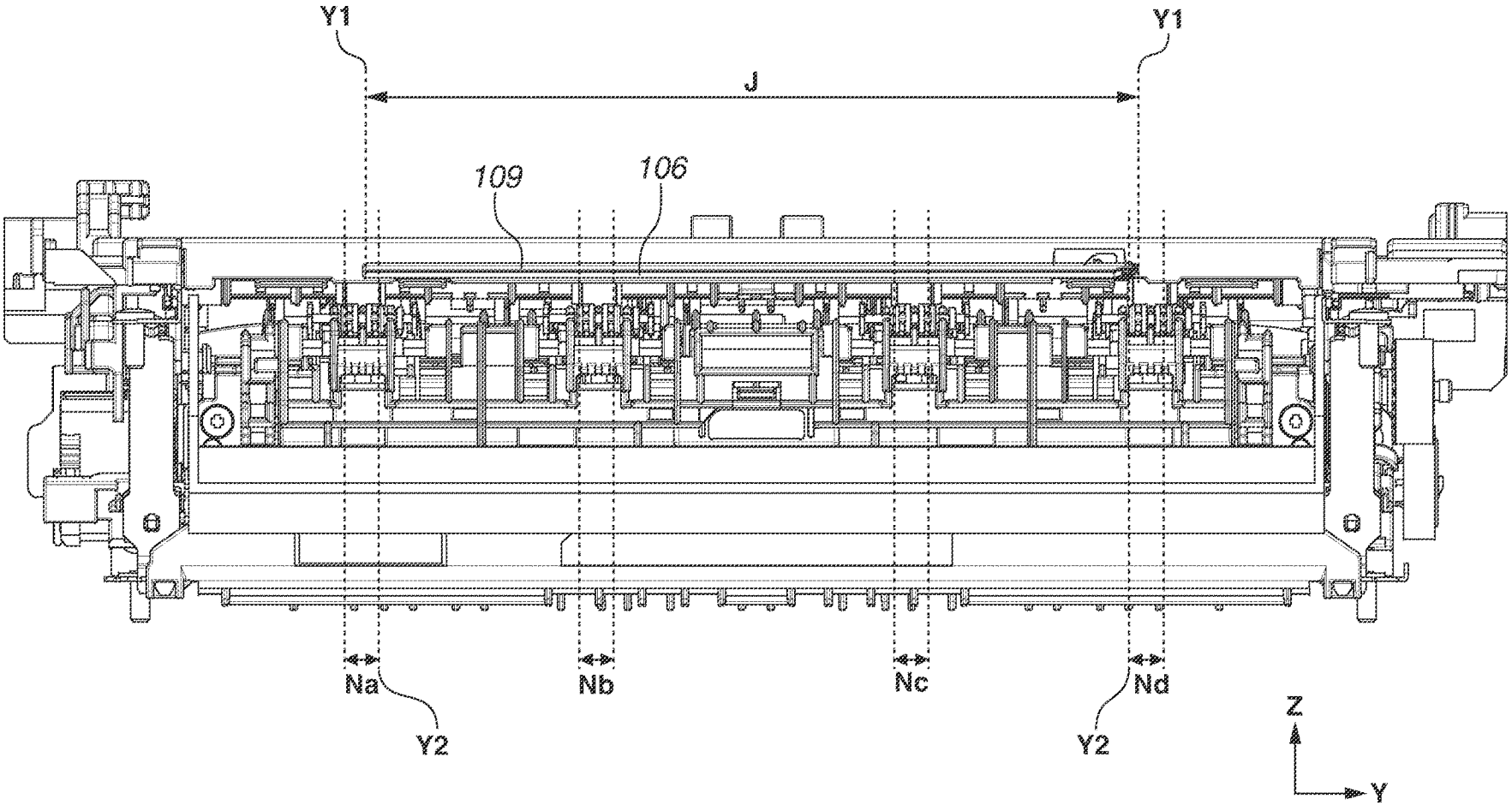
FIG. 4 is a schematic view of the discharge unit according to the first exemplary embodiment.

FIG. 4 is a schematic view of the discharge unit 15 viewed in an A direction in FIG. 1. As illustrated in FIG. 4, the static elimination cloth 106 and the static elimination support member 109 in shapes extending parallel to the Y axis. The static elimination cloth 106 has a length J in the Y axis direction, and has outermost edge portions Y1 in the width direction of the sheet S. The discharge roller set includes the discharge roller 100 forming four nip areas Na, Nb, Nc, and Nd with the driven roller 101. Of the four nip areas, at the outermost nip areas are Na and Nd, and the positions of the innermost edge portions of the respective Na and Nd nip areas are nip area edge portions Y2. The static elimination member edge portions Y1 are outside the nip area edge portions Y2. In other words, the static elimination member edge portions Y1 each are in the corresponding nip area.

The static elimination cloth 106 eliminates electric charge from the entire area of the sheet S near the fiber surface 108 as a static elimination surface. The static elimination member edge portions Y1 in the nip areas Na and Nd allows electric charge in the entire width of the sheet S built up through a rub of the sheet S with the discharge roller set in the nips to be eliminated with efficiency. In some embodiments, not limited to the above configuration, the static elimination member edge portions Y1 are located at positions corresponding to the edge portions of a standard sheet of the sheet S, such as a letter (LTR) sheet and an A4 sheet.

Figure 5:
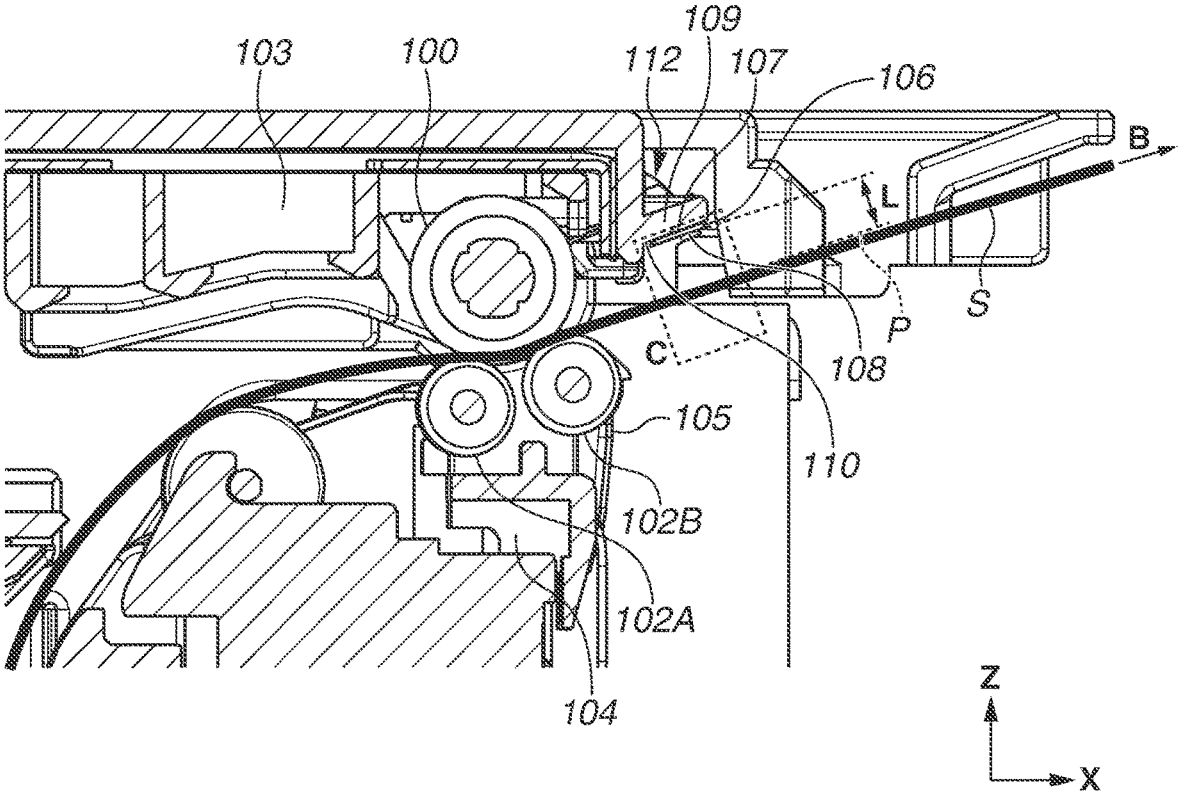
FIG. 5 is a schematic cross-sectional view illustrating a discharge operation by the discharge unit according to the first exemplary embodiment.

Next, a discharge operation by the discharge unit 15 will be described with reference to FIG. 5. FIG. 5 is a schematic cross-sectional view illustrating a discharge operation by the discharge unit 15. As illustrated in FIG. 5, the sheet S is conveyed from the fixing unit 14 upstream from the discharge unit 15 to the discharge roller set, and discharged in the conveyance direction E by the discharge roller set. The sheet S to be discharged by the discharge roller set passes substantially along the virtual tangent line P illustrated downstream from the nip portion formed by the discharge roller 100 and the discharge roller 102B. The virtual tangent line P is set through calculation of an average passing path to convey and discharge the sheet S based on experiment and analysis. As users use an apparatus in various operation environments with different basis weights of sheets S, the sheets S are conveyed and discharged along varying lines along or near the virtual tangent line P. In addition, the path of conveying and discharging sheets can vary due to changes in conveyance conditions at leading edges, centers, and trailing edges of sheets S. In view of the variations, the virtual tangent line P according to the present exemplary embodiment is a straight line with an angle of about 20 degrees to the horizontal line drawn from the contact portion between the discharge roller 100 and the discharge roller 102B.

The sheet S has electric charge over itself built up through rubbing friction with guide parts when the sheet S passes in each conveyance path upstream from the discharge roller set and through a separation of the sheet S from roller pairs of the fixing unit 14. On the other hand, in the area downstream from the discharge roller set, electric charge over the sheet S is eliminated with the static elimination cloth 106 near and downstream from the discharge roller set. This configuration allows the sheet S to be discharged after electric charge is eliminated in an area including the static elimination cloth 106, especially in and near an area C.

The fiber surface 108 of the static elimination cloth 106 supported by the static elimination support member 109 is disposed substantially parallel to and away from the virtual tangent line P by a distance L to have a high static elimination effect. A too short distance between the sheet S to be discharged by the discharge roller set and the static elimination cloth 106 can cause paper jams or image defects as results of conveyance failures due to contact with each other. In the present exemplary embodiment, the distance L is set to approximately 3.6 mm as an appropriate distance L to prevent the sheet S from coming into contact with the static elimination cloth 106 and ensure electric charge elimination. In addition, the distance L between the sheet S and the static elimination cloth 106 is secured during the conveyance of the sheet S. It is therefore suitable to provide the static elimination cloth 106 near and downstream from the discharge roller set, where the sheet S has a stable orientation and position.

Figure 6A:
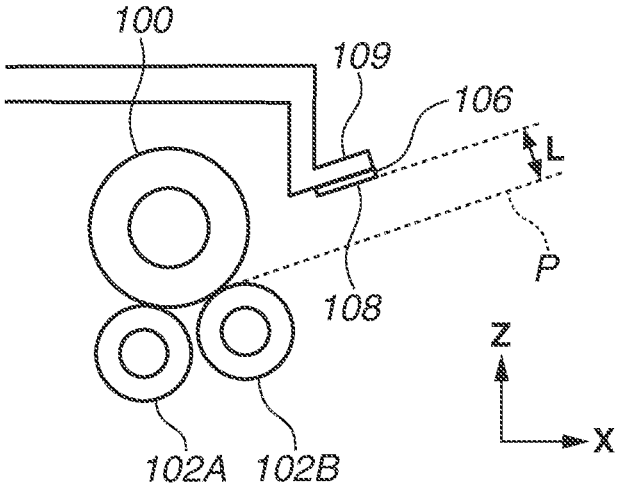
FIGS. 6A to 6C are schematic diagrams of cross sections of the discharge unit according to the first exemplary embodiment.
Figure 6B:
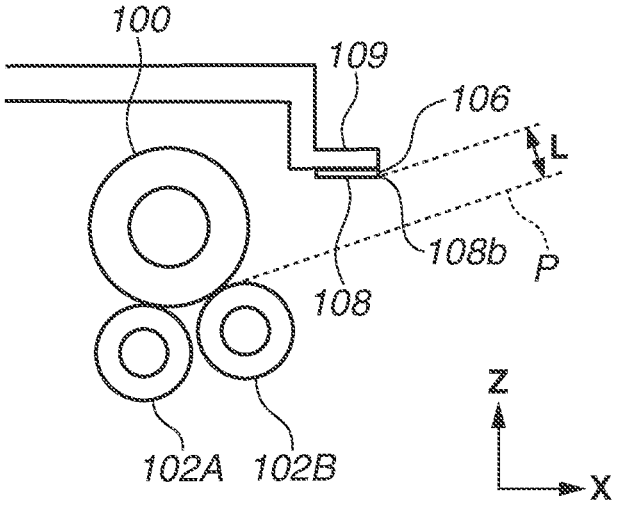
Figure 6C:
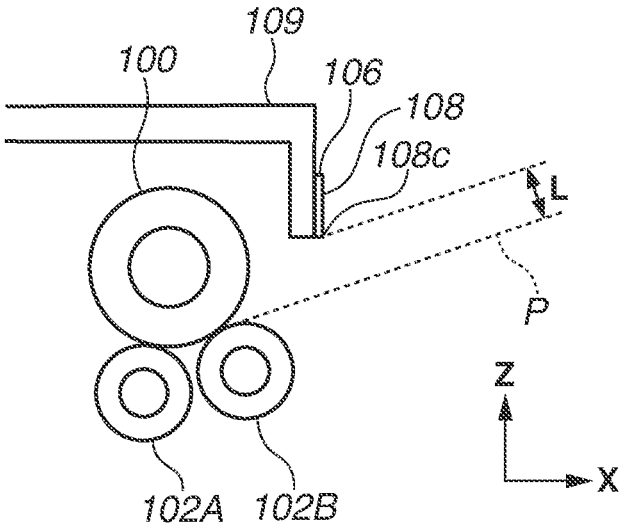

FIGS. 6A to 6C are schematic diagrams of cross sections of the discharge unit 15. The configurations illustrated in FIGS. 6A, 6B, and 6C are referred to as a configuration A, a configuration B, and a configuration C, respectively. The configuration A is a schematic diagram of the configuration according to the present exemplary embodiment, but the configuration B or the configuration C is applicable. The reference numerals of main components in the schematic diagram are the same as those in the detailed drawings. In any configuration, the shortest distance from the virtual tangent line P to the fiber surface 108 is the distance L, which is set to an appropriate distance not to cause a paper jam or an image defect due to a conveyance failure.

A comparison of remaining amounts of electric charge on the sheet S between the configurations A, B, and C shows the configuration C>the configuration B>the configuration A. In short, the configuration A has the highest effect. The differences in the static elimination effect is due to differences in the size of an area formed with the distance L as a distance from the virtual tangent line P to the fiber surface 108 in each configuration. In the configuration A, the fiber surface 108 is entirely away from the virtual tangent line P by the distance L. However, in the configurations B and C, the fiber surface edge portions 108*b* and 108*c*, respectively, are away from the virtual tangent line P by the distance L to the virtual tangent line P, and the distance is more than the distance L in the other areas. In other words, the static elimination effect is higher with a larger area from the virtual tangent line P to the fiber surface 108 of the static elimination cloth 106 by an appropriately set distance. The fiber surface 108 of the static elimination cloth 106 according to the present exemplary embodiment is substantially parallel to and away from the virtual tangent line P by the distance L to maximize the static elimination effect.

In addition to the above-described configuration, the fiber surface 108 with angles to the horizontal line of less than or greater than 20 degrees could have some effect of static elimination as long as the distance L is appropriate. In other words, the fiber surface 108 as the static elimination surface is substantially parallel to the virtual tangent line P with angles between the fiber surface 108 and the virtual tangent line P of less than or equal to 20 degrees. Otherwise, the same is applicable to a configuration in which a part of the fiber surface 108 is set to the distance L and in which the other part is set to larger than the distance L.

As described above, the discharge unit 15 in the multifunction peripheral 10 is configured to prevent contact with the sheet S passing through the discharge unit 15 and to efficiently eliminate electric charge from the sheet S with the static elimination cloth 106 substantially parallel to the sheet S and away from the sheet S passing through the discharge unit 15 by the distance L.

A second exemplary embodiment of the present disclosure will be described. According to the second exemplary embodiment, a multifunction peripheral 10 to which the present disclosure is applied has a basic configuration similar to that according to the first exemplary embodiment. Like reference numerals refer to like elements having the same or corresponding functions and configurations as or to those according to the first exemplary embodiment, and the redundant detailed descriptions thereof will be omitted.

Figure 7:
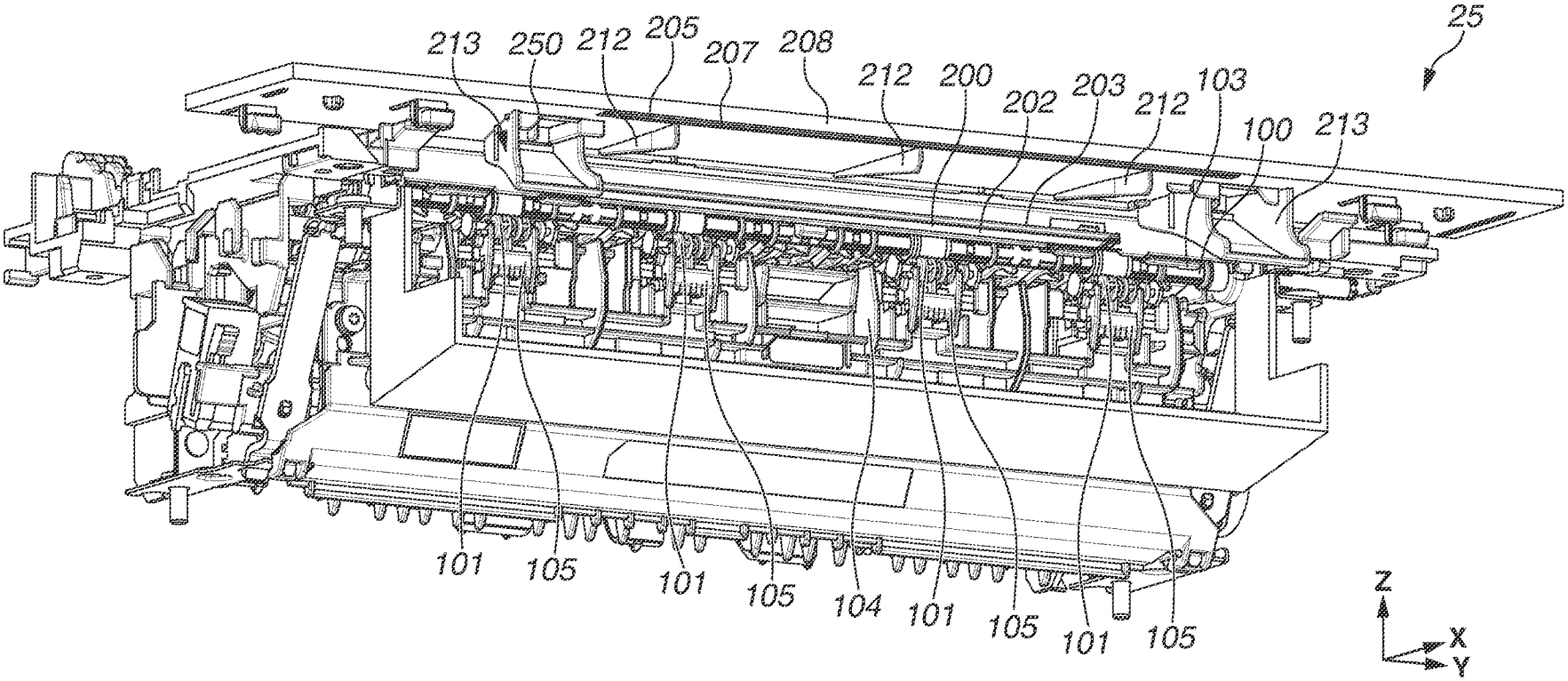
FIG. 7 is a schematic perspective view of a discharge unit according to a second exemplary embodiment.
Figure 8:
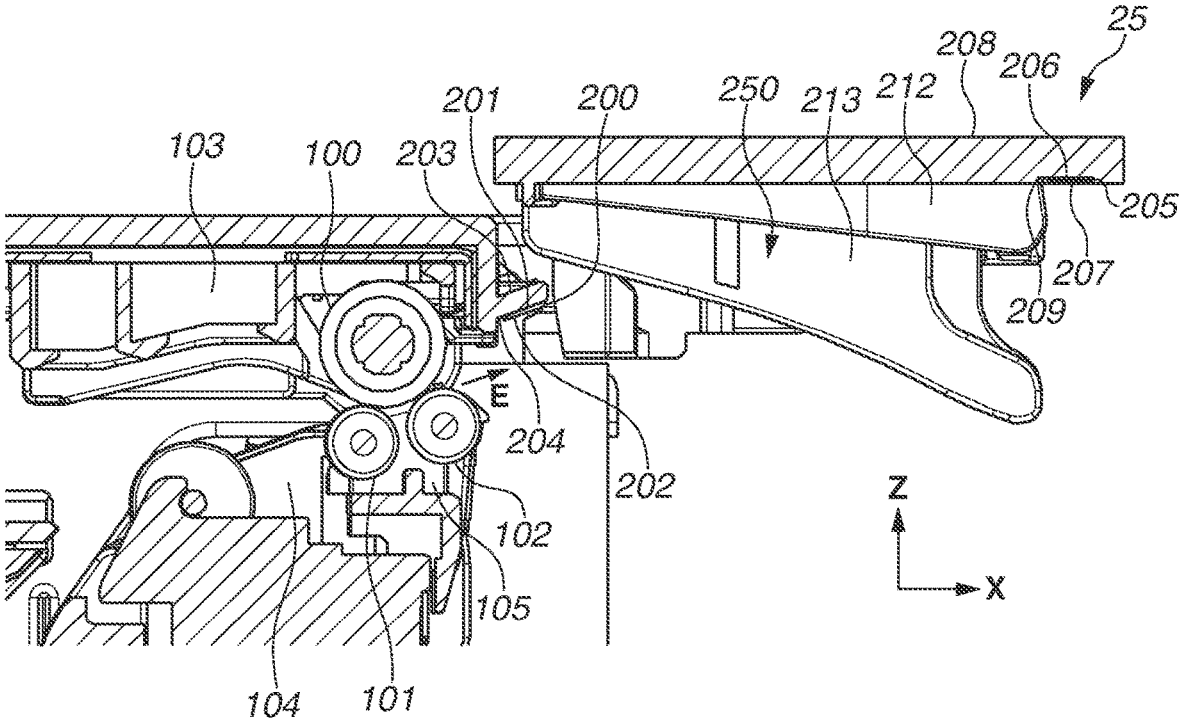
FIG. 8 is a schematic cross-sectional view near a discharge roller set in the discharge unit according to the second exemplary embodiment.

First, a configuration of a discharge unit 25 as a sheet discharge device according to the second exemplary embodiment will be described in detail with reference to FIGS. 7 to 9. FIG. 7 is a schematic perspective view of the discharge unit 25, and FIG. 8 is a schematic cross-sectional view near a discharge roller set in the discharge unit 25.

The discharge unit 25 includes a guide unit 250 guiding sheets in the discharge direction in contact with each sheet. The guide unit 250 according to the present exemplary embodiment includes at least conveyance ribs 212 and outer conveyance ribs 213. The conveyance ribs 212 regulate the conveyance position near the center of the sheet S in the width direction, and the outer conveyance ribs 213 regulate the conveyance position near the outer areas of the sheet S in the width direction.

A static elimination unit according to the present exemplary embodiment includes a first static elimination cloth 200 as a first static elimination member and a second static elimination cloth 205 as a second static elimination member. The first static elimination cloth 200 is at a position near the discharge roller set as with the static elimination cloth 106 according to the first exemplary embodiment, and is a first static elimination cloth according to the present exemplary embodiment. The second static elimination cloth 205 is disposed downstream from the conveyance ribs 212 and the outer conveyance ribs 213 in the conveyance direction E of the sheet S. The conveyance ribs 212 and the outer conveyance ribs 213 each have shapes defined in consideration of conveyance properties and stacking properties of sheets S to be discharged. Discharged sheets S are typically curled at their edge portions in their width direction by the fixing unit 14. To reduce the curl, the outer conveyance ribs 213 are at a position lower than the conveyance ribs 212 in the Z direction.

The first static elimination cloth 200 shapes in a sheet-like form having an adhesion surface 201 and a fiber surface 202 opposite the adhesion surface 201. The second static elimination cloth 205 as the second static elimination cloth shapes in a sheet-like form having an adhesion surface 206 and a fiber surface 207 opposite the adhesion surface 206. The first static elimination cloth 200 is fixed to and supported by a first static elimination support member 203 with the adhesion surface 201 adhering to a support surface 204 of the first static elimination support member 203 with double-sided adhesive tape.

The first static elimination support member 203 as a first static elimination support member and a second static elimination support member 208 are exterior components of the image forming apparatus 30, and the support surface 204 and a support surface B 209 are provided as a part of the exterior component. The fixed and supported fiber surface 202 is exposed to the conveyance area of the sheet S. The second static elimination cloth 205 is fixed to and supported by the second static elimination support member 208 with the adhesion surface 206 adhering to the support surface B 209 of the second static elimination support member 208 with double-sided tape. The fixed and supported fiber surface 207 is exposed to the conveyance area of the sheet S.

Figure 9:
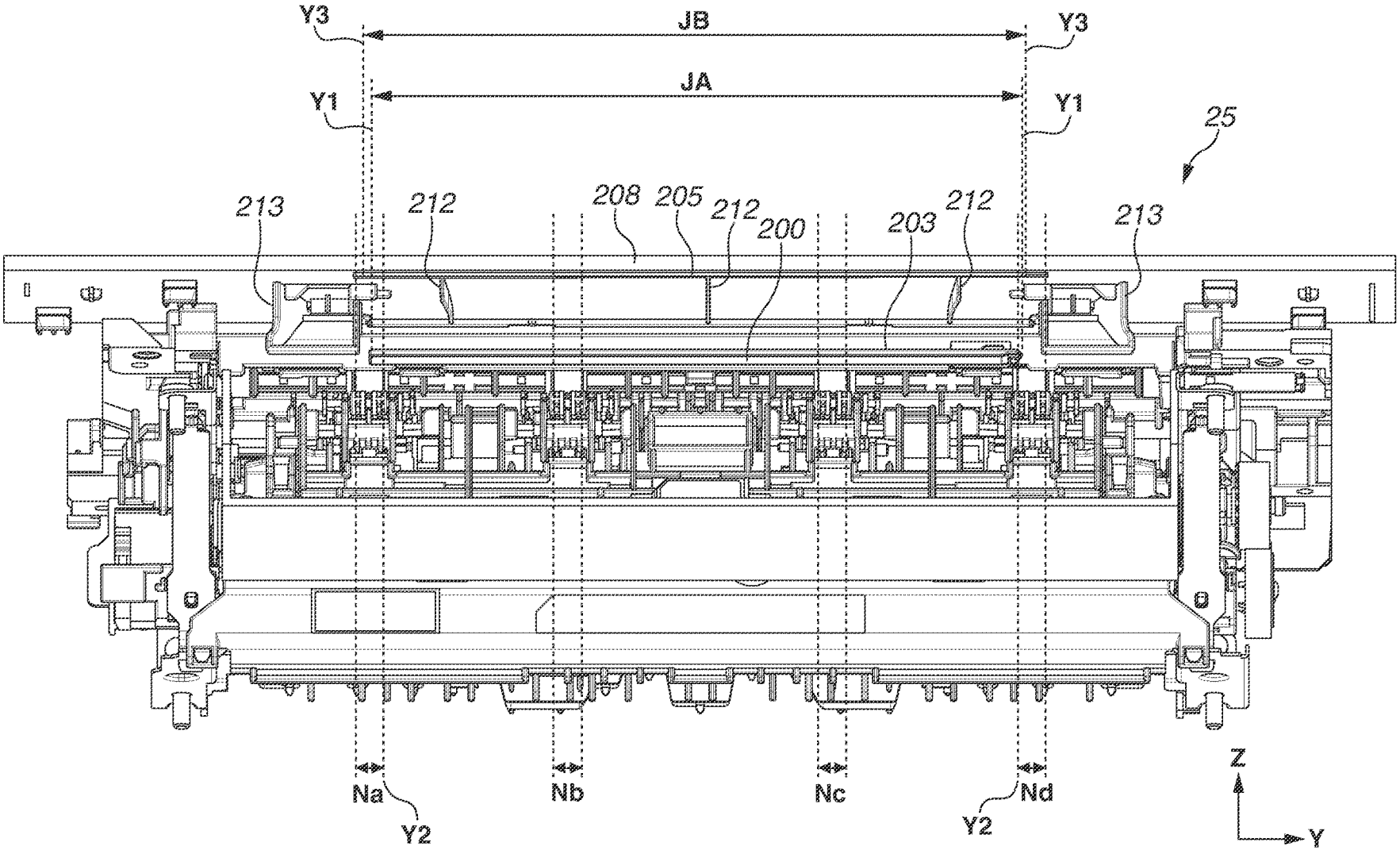
FIG. 9 is a schematic view of the discharge unit according to the second exemplary embodiment.

FIG. 9 is a schematic view of the discharge unit 25 viewed in the A direction in FIG. 1. As illustrated in FIG. 9, the first static elimination cloth 200, the second static elimination cloth 205, the first static elimination support member 203, and the second static elimination support member 208 form in shapes extending parallel to the Y axis. The first static elimination cloth 200 and the second static elimination cloth 205 have lengths JA and JB in the Y axis direction, respectively, and their outermost edge portions are located at the positions indicated by static elimination member edge portions Y1 and Y3. As with the first exemplary embodiment, of the four nip areas Na, Nb, Nc, and Nd of the discharge roller set, the outermost nip areas are Na and Nd, and the innermost edge portions of the nip areas Na and Nd are at the positions indicated by nip area edge portions Y2. The static elimination member edge portions Y1 and Y3 are located outside the nip area edge portions Y2.

Figure 10:
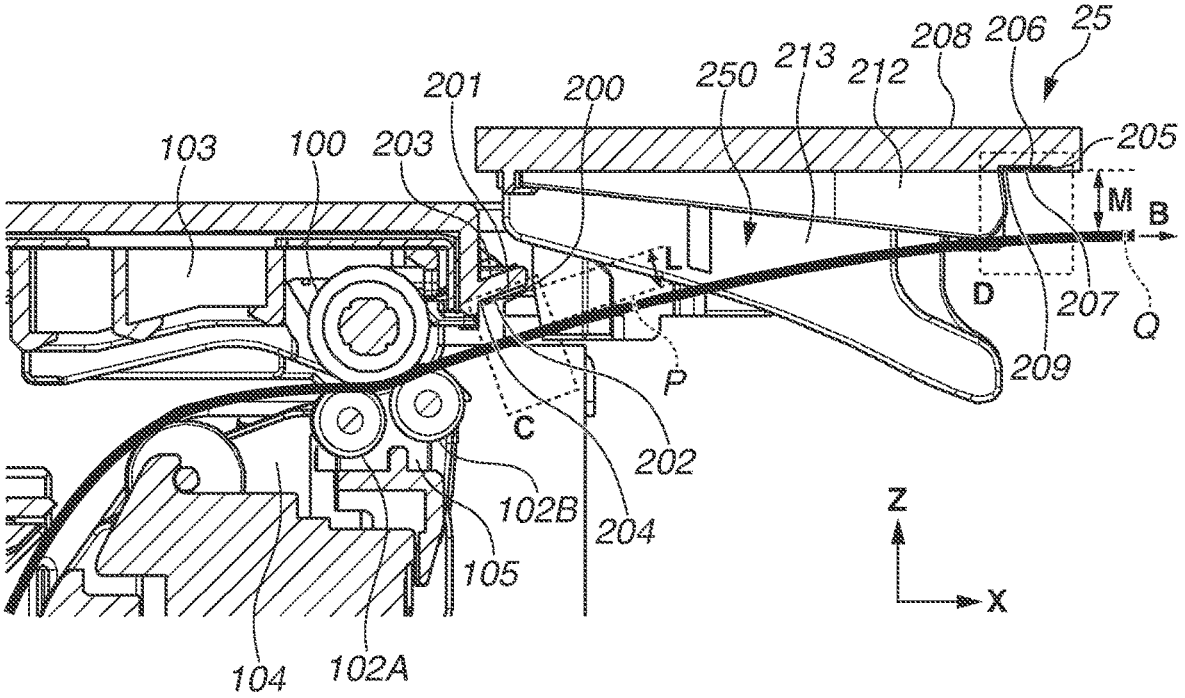
FIG. 10 is a schematic cross-sectional view illustrating a discharge operation by the discharge unit according to the second exemplary embodiment.

Next, a discharge operation by the discharge unit 25 will be described with reference to FIG. 10. FIG. 10 is a schematic cross-sectional view illustrating a discharge operation by the discharge unit 25 especially near the center of the sheet S in the width direction. As illustrated in FIG. 10, as with the first exemplary embodiment, the sheet S is sent from the fixing unit 14 upstream from the discharge unit 25 to the discharge roller set, and is discharged in a direction B by the discharge roller set. The sheet S discharged near the discharge roller set passes substantially along the virtual tangent line P downstream from the nip portion between the discharge roller 100 and the discharge roller 102B. In addition, the conveyance ribs 212 also serve as regulation portions for regulating the discharge direction of the sheet S in contact with the sheet S to cause the discharged sheet S to be sent away from the first static elimination cloth 200 by a predetermined distance L.

In addition, near the second static elimination cloth 205, the sheet S is regulated by the conveyance ribs 212 to pass substantially along a conveyance position Q. As with the first exemplary embodiment, the virtual tangent line P and the conveyance position Q are determined in consideration of the variations in sheets S. In the area upstream from the discharge roller set, the sheet S is entirely electrically charged due to rubbing with guide components while the sheet S is passing in each conveyance path and to a separation of the sheet S from roller pairs of the fixing unit 14 in conveyance. On the other hand, in the area downstream from the discharge roller set, the entire charge on the sheet S is eliminated with the first static elimination cloth 200 near and downstream from the discharge roller set and with the second static elimination cloth 205 downstream from the conveyance ribs 212. This configuration allows the sheet S to be discharged after the electric charge is eliminated from the sheet S in an area C in which the first static elimination cloth 200 is located and in an area D in which the second static elimination cloth 205 is located.

The fiber surface 202 of the first static elimination cloth 200 is substantially parallel to and away from the virtual tangent line P by the distance L as with the first exemplary embodiment. In addition, the fiber surface 207 of the second static elimination cloth 205 is substantially parallel to and away from the conveyance position Q by a distance M. As with the first static elimination cloth 200, the distance M between the sheet S and the second static elimination cloth 205 is appropriately determined. As with the first static elimination cloth 200, the distance M between the sheet S and the second static elimination cloth 205 is secured during the conveyance of the sheet S. It is suitable to dispose the second static elimination cloth 205 near the conveyance ribs 212 on the second static elimination support member 208, the conveyance ribs 212 of which stabilizes the orientation and position of the sheet S. The distance L and the distance M may be not the same, and are set to values in consideration of the conveyance of sheets S in each area.

Figure 11:
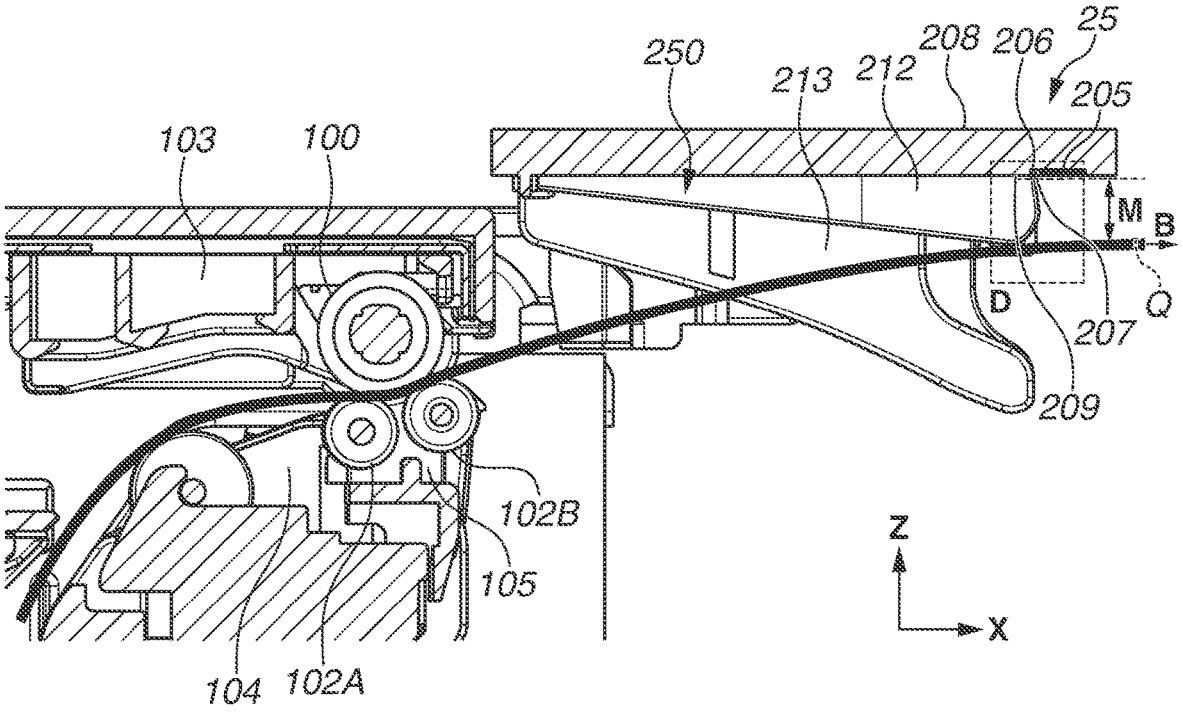
FIG. 11 is a schematic cross-sectional view illustrating a discharge operation by the discharge unit according to the second exemplary embodiment.
Figure 12:
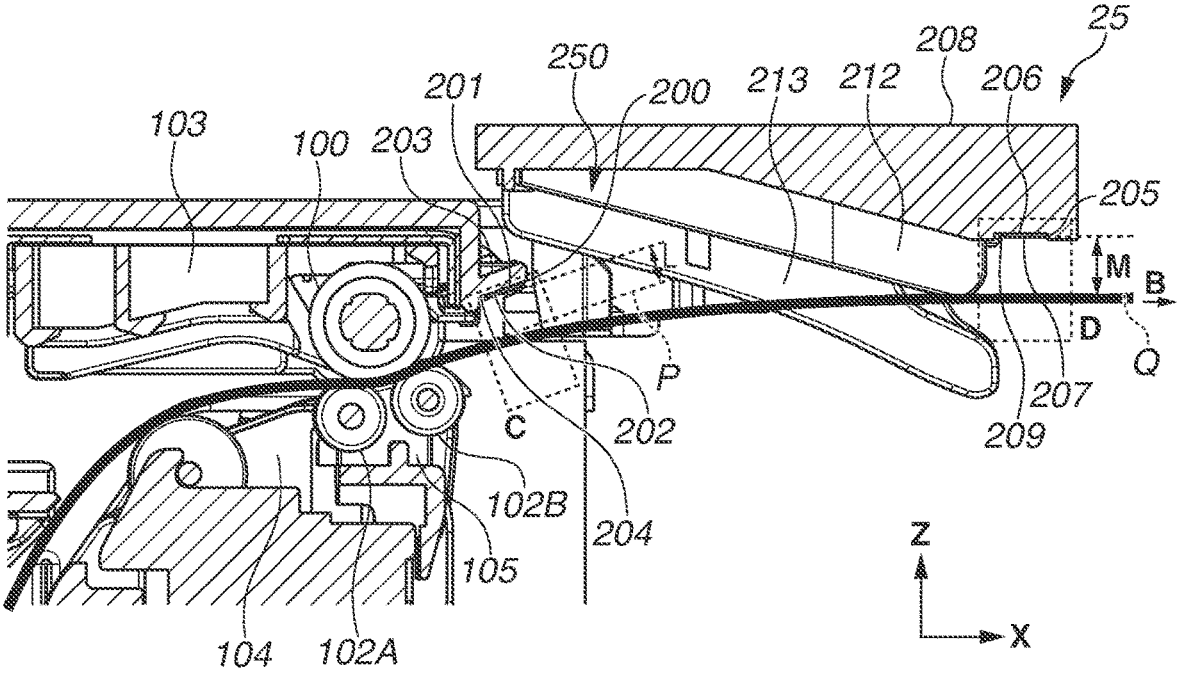
FIG. 12 is a schematic cross-sectional view illustrating a discharge operation by the discharge unit according to the second exemplary embodiment.

According to the present exemplary embodiment, the configuration has been illustrated in which the first static elimination cloth 200 and the second static elimination cloth 205 are provided near the discharge roller set and the conveyance ribs 212, respectively. However, the configuration may have the second static elimination cloth 205 illustrated in FIG. 11 without the first static elimination cloth 200. For the conveyance ribs 212 at different positions or in different shapes, it is suitable for the second static elimination cloth 205 to be disposed at a position that secures the distance M with the conveyance ribs 212 at different positions or in different shapes as illustrated in FIG. 12. Thus, in addition to other than the above-described exemplary embodiments, the effect of the present disclosure is achieved.

As described above, the discharge unit 25 in the multifunction peripheral 10 is configured to discharge the sheet S after electric charge on the sheet S is efficiently eliminated with the first static elimination cloth 200 away from the sheet S by the distance L and with the second static elimination cloth 205 away from the sheet S by the distance M.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-098734, filed Jun. 5, 2020, which is hereby incorporated by reference herein in its entirety.

What is claimed is:

1. A sheet discharge device to discharge a sheet, the sheet discharge device comprising:

a discharge unit including a drive roller to be rotated by a driving force received from a drive source and a driven roller to be driven by the drive roller, wherein the discharge unit is configured to discharge the sheet out of a discharge nip portion between the drive roller and the driven roller; and a static elimination unit located downstream from the discharge unit in a sheet discharge direction and configured to eliminate electric charge from the sheet to be discharged by the discharge unit, wherein the static elimination unit includes a support member and a static elimination cloth supported by the support member, wherein the support member includes a support surface that is fixed at a position away from a movement path of the sheet discharged from the discharge unit and has a shape extending with respect to the sheet discharge direction, and wherein the static elimination cloth is supported by the support surface, has electroconductive fiber, faces the sheet to be discharged by the discharge unit, and has a facing surface facing the sheet discharged from the discharge unit where the facing surface is a surface extending along the extension direction of the support surface.

2. The sheet discharge device according to claim 1, wherein the static elimination cloth includes an adhesion surface adhering to the support member, and wherein the support surface fixes the static elimination cloth to the support member, where the support surface supports the static elimination cloth by the adhesion surface of the static elimination cloth adhering to the support member.

3. The sheet discharge device according to claim 1, wherein the driven roller includes a first driven rotation member forming the discharge nip portion with the drive roller, and a second driven rotation member configured to be driven by the drive roller and located upstream from the first driven rotation member in the sheet discharge direction.

4. The sheet discharge device according to claim 3, wherein the driven roller includes a plurality of first driven rotation members, including the first driven rotation member, arranged in an axial direction of the driven roller, and wherein an edge portion of the static elimination cloth in the axial direction is located in an area in which the first driven rotation member, located at an outermost area of the plurality of first driven rotation members, is in contact with the drive roller.

5. The sheet discharge device according to claim 1, further comprising a guide unit configured to guide the sheet discharged by the discharge unit, wherein the guide unit is in contact with the discharged sheet and located downstream from the discharge unit in the sheet discharge direction.

6. The sheet discharge device according to claim 5, wherein the static elimination unit includes the static elimination cloth as a first static elimination cloth between the discharge unit and the guide unit in the sheet discharge direction.

7. The sheet discharge device according to claim 6, wherein the guide unit includes a regulation portion configured to regulate the sheet so that a distance between the first static elimination cloth and the discharged sheet is a predetermined distance.

8. The sheet discharge device according to claim 7, wherein the static elimination unit includes a second static elimination cloth downstream from the regulation portion in the sheet discharge direction.

* * * * *